US009908753B2

(12) United States Patent
Weingartner et al.

(10) Patent No.: US 9,908,753 B2
(45) Date of Patent: Mar. 6, 2018

(54) CHAIN HOIST WITH IMPROVED CHAIN ENTRY

(71) Applicant: Konecranes PLC, Hyvinkaa (FI)

(72) Inventors: Jurgen Weingartner, Kunzelsau-Kocherstetten (DE); Dominik Muller, Gotzingen (DE); Bernhard Rusam, Kupferzell (DE)

(73) Assignee: KONECRANES PLC, Hyvinkää (FI)

( * ) Notice: Subject to any disclaimer, the term of this patent is extended or adjusted under 35 U.S.C. 154(b) by 0 days.

(21) Appl. No.: 14/651,982

(22) PCT Filed: Dec. 6, 2013

(86) PCT No.: PCT/EP2013/075806
§ 371 (c)(1),
(2) Date: Oct. 14, 2015

(87) PCT Pub. No.: WO2014/090703
PCT Pub. Date: Jun. 19, 2014

(65) Prior Publication Data

US 2016/0031684 A1 Feb. 4, 2016

(30) Foreign Application Priority Data

Dec. 14, 2012 (DE) ..... 10 2012 112 329

(51) Int. Cl.
*B66D 1/36* (2006.01)
*B66D 3/26* (2006.01)
(Continued)

(52) U.S. Cl.
CPC ..... *B66D 1/36* (2013.01); *B66D 3/12* (2013.01); *B66D 3/16* (2013.01); *B66D 3/26* (2013.01)

(58) Field of Classification Search
CPC ... B66D 3/16; B66D 3/26; B66D 3/12; B66D 1/36
See application file for complete search history.

(56) References Cited

U.S. PATENT DOCUMENTS 2,652,018 A * 9/1953 Griffith ..... B63B 21/14 114/180
2,656,150 A * 10/1953 Lock ..... B66D 3/26 254/372
(Continued)

FOREIGN PATENT DOCUMENTS

DE 12 28 384 A 11/1966
DE 2548569 A1 6/1976
(Continued)

OTHER PUBLICATIONS

Office Action dated Apr. 6, 2016, in Chinese Patent Application No. 201380065665.4, filed Dec. 6, 2013 (w/ English-language translation).
(Continued)

*Primary Examiner* — Michael E Gallion
(74) *Attorney, Agent, or Firm* — Leydig, Voit & Mayer, Ltd.

(57) ABSTRACT

A chain hoist (10) having an improved chain guide (12) for a link chain (14). The chain guide (12) has a channel (36) with a cross-shaped cross section, through which the link chain (14) extends. An end surface (26) of the chain guide (12) extends away from a mouth opening (28) of the channel (36). The channel (36) establishes a through-passage direction (D) which widens in the direction of the end surface (26), and a protrusion (30) is formed on the end surface (26) around the mouth opening (28) of the channel (36).

18 Claims, 3 Drawing Sheets

(51) Int. Cl.
*B66D 3/16* (2006.01)
*B66D 3/12* (2006.01)

(56) References Cited

U.S. PATENT DOCUMENTS

| | | | | | |
|---|---|---|---|---|---|
| 2,680,594 | A * | 6/1954 | Jackson | B66D 3/04 | 114/179 |
| 2,973,566 | A * | 3/1961 | Elsner | F16G 15/00 | 24/116 R |
| 2,999,623 | A * | 9/1961 | King | B66D 3/26 | 226/196.1 |
| 3,030,076 | A | 4/1962 | Stevens | | |
| 3,382,730 | A * | 5/1968 | Roggatz | B66D 3/26 | 474/140 |
| 3,499,629 | A * | 3/1970 | Horton | B66D 3/006 | 254/106 |
| 3,860,215 | A * | 1/1975 | Chambers | B66F 1/08 | 254/110 |
| 4,031,939 | A * | 6/1977 | De Martini | B25B 27/22 | 152/213 R |
| 4,235,074 | A * | 11/1980 | Larson | F16G 13/12 | 254/389 |
| 4,398,387 | A * | 8/1983 | Bary | B66D 3/16 | 254/371 |
| 4,448,397 | A * | 5/1984 | Broyden | B66D 3/26 | 254/360 |
| 4,576,363 | A | 3/1986 | Pancook | | |
| 4,679,800 | A * | 7/1987 | Burton | B63B 21/14 | 114/180 |
| 4,881,720 | A | 11/1989 | Nishimura | | |
| 5,007,617 | A * | 4/1991 | Nishimura | B66D 3/14 | 254/358 |
| 5,644,821 | A * | 7/1997 | Zaguroli, Jr. | B66D 3/24 | 24/114.5 |
| 6,431,102 | B1 * | 8/2002 | Askestad | B63B 21/14 | 114/200 |
| 6,568,165 | B2 * | 5/2003 | Smetz | B66C 1/125 | 24/116 R |
| 6,817,595 | B1 * | 11/2004 | Jenkins | B63B 21/10 | 114/200 |
| 2003/0102397 | A1 * | 6/2003 | Chambers | B66D 1/72 | 242/372 |
| 2003/0197160 | A1 * | 10/2003 | Curtis | E06B 9/78 | 254/358 |
| 2004/0211951 | A1 * | 10/2004 | Rosati | B66D 3/16 | 254/358 |
| 2007/0145339 | A1 * | 6/2007 | Beaudoin | B66D 3/12 | 254/372 |
| 2008/0224110 | A1 * | 9/2008 | Starks | B66D 3/20 | 254/264 |
| 2010/0175604 | A1 * | 7/2010 | Boatman | B63B 21/18 | 114/200 |
| 2011/0198547 | A1 * | 8/2011 | Matos | B66D 1/72 | 254/323 |
| 2012/0042481 | A1 * | 2/2012 | Kempf | H02G 1/06 | 24/116 R |
| 2012/0181492 | A1 * | 7/2012 | Matos | B66D 1/12 | 254/323 |
| 2013/0043447 | A1 * | 2/2013 | Farrell, III | B66D 3/006 | 254/264 |
| 2013/0091823 | A1 * | 4/2013 | Abrisketa Lozano | B63B 21/20 | 59/1 |
| 2014/0353563 | A1 * | 12/2014 | Sargent | B66D 3/16 | 254/342 |
| 2016/0068378 | A1 * | 3/2016 | Copin | B66D 3/20 | 254/385 |

FOREIGN PATENT DOCUMENTS

| | | | |
|---|---|---|---|
| DE | 25 48 549 | A1 | 5/1977 |
| DE | 31 42 472 | A1 | 5/1983 |
| DE | 29 903 735 | U1 | 9/1999 |
| DE | 102 36 027 | B3 | 2/2004 |
| DE | 103 36 027 | B3 | 4/2005 |
| EP | 0878433 | A2 | 11/1998 |
| GB | 954 104 | A | 4/1964 |
| JP | S54 50378 | U | 4/1979 |
| JP | S61 52695 | U | 4/1986 |

OTHER PUBLICATIONS

European Patent Office, International Search Report in the International Patent Application No. PCT/EP2013/075806 (dated Feb. 21, 2014).

* cited by examiner

CHAIN HOIST WITH IMPROVED CHAIN ENTRY

FIELD OF THE INVENTION

The present invention relates to chain hoists and particularly to an entry arrangement for the chain to the hoist.

BACKGROUND OF THE INVENTION

Chain hoists are used for lifting and lowering items, as we all pulling loads. To do so, a link chain, in particular a circular steel chain or a round profile chain is used. Usually, a chain hoist comprises a holder, for example a hook, which can be suspended from a scaffolding. The hook is adjoined by a chain hoist housing with a lifting motor that drives a chain sprocket over which the chain moves. A load hook is arranged on the free end of the chain. The housing comprises an opening with an adjoining channel through which the part of the chain disposed for bearing the load moves onto the chain sprocket. Such a channel frequently has a cruciform cross-section in order to guide a link chain that consists of several, preferably equal, chain links that alternately come into engagement with each other while oriented in transverse direction relative to each other. The channel acts as a controlled guide of the chain.

Particular chain hoists for stage technology, also referred to as rigger hoists, have a design that is inverted with respect to an embodiment described hereinabove. In that case, the lose end of the chain is disposed for fastening the chain hoist at a desired height. The hook provided on the housing is disposed for taking up the load. During operation, the load, together with the housing on the chain, is pulled up or lowered.

When the chain hoist is dismantled after its use, the housing is placed on the stage floor or put on a trestle there, and the chain that is fastened at a given height is loosened and let down onto the housing. In doing so, the chain comes to rest on the surface of the housing—in the region of the opening, i.e., the mouth opening of the channel having the cruciform cross-section. The hoisting motor is used to retract the chain through the housing into the chain storage. In doing so, it may happen that a chain link positions itself sideways in front of the channel and thus blocks the continued retraction of the chain. With great effort, the operator has to then manually eliminate the blockage. The retraction process is tedious, and the operator is occupied during the entire retraction process.

To solve this technical problem, German Patent 1 228 384 suggests a guide channel that widens toward the housing surface. Therefore, a space is created in one end-side section of the channel, in which space a sideways positioned chain link may rotate before it is guided in a retraction direction through the tapering channel. The torque required for rotation is applied to the sideways positioned chain link by the subsequent chain link that strikes the sideways positioned chain link due to the transverse orientation.

OBJECTS AND SUMMARY OF THE INVENTION

It is the object of the invention to provide a chain hoist with an improved chain guide or entry to the hoist.

The chain hoist according to the invention comprises a chain guide for a link chain, hereinafter also referred to as chain, wherein the chain guide comprises a channel having a cruciform cross-section through which the chain extends.

Furthermore, the chain guide has an end surface that extends from one mouth opening of the channel away from said channel. Preferably, the end surface extends from the mouth opening of the channel away from said channel in at least one direction and in the opposite direction. The link chain enters at the mouth opening of the channel in through-passage direction into said channel. The channel widens toward the end surface. A protrusion is formed on the end surface, symmetrically, or asymmetrically around the mouth opening of the channel.

A section of the chain may abut against or be supported by the end surface. In the event that, with the use of a chain hoist according to the invention, the chain comes to lie on the end surface of the chain hoist as a disorderly pile, a chain link then can be pulled first over the protrusion and thus away from the end surface before its passage on the protrusion through the end surface, as a result of which the chain need only be slightly tensioned locally. In this manner, the frequency of an occurrence of a sideways position of chain links can be minimized prior to entering the channel and thus before the chain is pulled in.

The chain hoist according to the invention may comprise one or more chain guides. For example, one chain guide may be arranged on a housing of the chain hoist and guide the chain onto a chain sprocket.

The chain guide is adapted to guide a link chain. Considering this, each chain link is oriented transversely with respect to its adjacent chain link. A chain link may also be a round link or a profile link. For example, a chain link may consist of steel, aluminum or plastic, or comprise one or more materials or also a combination of the aforementioned materials. A chain link is torus-shaped and has a round cross-section, a polygonal cross-section or the like, in which case the torus body of a chain link is preferably elongated in one direction. The largest inside dimension of a chain link is referred to as the division and the smallest inside dimension is referred as the inside width. The outside width of the chain link is measured on the same plane as the division and also the inside width. The difference between the outside and the inside widths is the width of the chain link body. The chain link has a thickness transverse to the measured direction of the out and inner widths. The length of a chain link (chain link length) corresponds to the sum of the width and the division.

The channel of the chain guide has a cruciform cross-section, wherein the cross-section extends transversely to a (local) guide direction. The channel guides the chain, i.e., it confines its direction of movement transversely to the guide direction. The chain may display a certain play, or it may be guided without play, in the channel transversely to the guide direction. The channel with the cruciform cross-section prevents or greatly restricts an uncontrolled twisting of the chain about the guide direction, i.e., the chain is guided in the channel in a manner that it cannot be twisted. The chain extends through the channel along the guide direction.

The channel defines a through-passage direction. Preferably, the through-passage direction coincides with a guide direction existing in a mouth-opening-side section of the channel. The channel comprises a first guide groove pair and a second guide groove pair that are arranged transversely with respect to each other. Preferably, the guide groove pairs are oriented perpendicularly relative to each other. The first guide groove pair is adapted to guide chain links oriented in a first direction, and the second channel is adapted to guide chain links oriented transversely with respect to the first direction. Measured in the cross-section of the channel, one guide groove pair has a first extension and a second extension. The first extension of the guide groove pair is at least as great as the thickness of the chain link. The second extension of a guide pair is at least as great as the thickness of a chain link. Preferably, at least the first extension of a guide groove pair enlarges in the direction of the end surface. The channel widens in the direction toward the end face so that the first extension of the channel allows, at least in the region of the mouth opening of the channel, a twisting of the sideways positioned chain link. Preferably, the first extension of the channel does not allow a twisting or sideways position of a chain link in a section of the channel downstream of the mouth opening of the channel. The second extension of a guide groove pair may also increase or widen in the direction toward the end surface.

A guide groove pair can widen by at least one step in the direction of the end surface. The first extension of the guide groove pair measured in cross-section can thus widen abruptly at one point of the channel or widen at least over a short section along the channel guide. A widening of the first or the second extension can also be configured so as to be stepless or partially stepless, for example linear or arcuate. A guide groove pair may also be asymmetrical along the cross-section measured in longitudinal direction of the channel guide, i.e., for example, a guide groove pair of the channel may be configured so as to be widening in the direction of the end surface first on one side and, finally, also widening on the other side.

The part representing the protrusion may be a component that is separate from the part bearing the end surface and is adapted for being fastened to the part bearing the end surface. The part may be configured in one part or in several parts. The protrusion and the end surface may also be provided on the same component. The channel may continue in the protrusion. The channel in the protrusion may widen, in particular, along the through-passage direction. The channel widens in the direction toward the end surface, in which case said widening may also start only in the region of the protrusion or in the protrusion. A chain guide may have a channel that defines a through-passage direction that coincides with the perpendicular direction.

Preferably, the end surface is at least partially arcuate. For example, the end surface may be arcuate in at least one direction away from the mouth opening. Preferably, the end surface is curved in a convex manner away from the mouth opening in through-passage direction; however, it may also be concave. For example, the end surface may also be curved away from the mouth opening in several directions. For example, the end surface may have a spherical surface or be conical or pyramidal.

The end surface of a chain guide of the chain hoist may be set inclined relative to the through-passage direction. However, the end surface may also drop in an inclined manner in several directions. Preferably, the end surface is set inclined over at least one direction beyond the mouth opening. Preferably, the end surface is set so as to be inclined relative to the perpendicular direction.

The part where the end surface is provided may, for example, comprise metal such as, for example steel or siluminium, plastic material such as, for example, Teflon, wood, rubber and/or carbon. Preferably, the material of the part bearing the end surface is adapted to the chain link material in such a manner that a low sliding friction coefficient is achieved.

The protrusion may be formed around the mouth opening of the channel and extend beyond the mouth opening of the channel. For example, the protrusion may also relate to the crossing region of guide groove pairs or be restricted thereto, or be restricted to the mouth opening region. The protrusion may have surfaces (projecting surfaces) that extend the end surface on the protrusion. In this manner, a continuous transition or a bent transition or a transition with a step from the end surface to the protrusion is created. The protrusion forms an elevation above the end surface. The elevation formed by the protrusion may be symmetrical or asymmetrical transversely to the end surface. For example, the projecting surfaces of the protrusion may have different heights or distances relative to the end surface.

Preferably, the protrusion has a height that is greater than the thickness of a chain link. Furthermore, it is advantageous if the height of the protrusion is greater than the width of the chain link. Relative to the end surface, the protrusion has a height that amounts to 20% to 80% of a chain link length. In this manner, it is possible to achieve the above-described local tension of the chain in a particularly good manner.

A chain link may abut against the surfaces of the protrusion, said chain link following a chain link being oriented sideways. This may result in a rotation of the transversely oriented chain link. For example, the surfaces may be flat so that the protrusion has a projecting end plane that is offset relative to the end surface. In this manner, the protrusion may have the form of a cylinder or a truncated cone. Preferably however, the surfaces of the protrusion drop obliquely or arcuately toward the end surface. One surface of the protrusion the may initially rise toward the channel, viewed along the end surfaces, so that a part of the protrusion is formed in this manner, and then again drop toward the channel or toward the mouth opening of the channel so that a cavity is formed in the protrusion. The protrusion may have the form of a spherical segment or of a pyramid or have the form of a cone or truncated cone. The protrusion may be centered on the channel or the mouth opening.

The protrusion and/or the guide channel may comprise metal such as, for example, steel or siluminium, plastic material such as, for example, Teflon, wood, rubber and/or carbon. Preferably, the material of the protrusion and/or the guide channel is adapted to the chain link material in such a manner that a low sliding friction coefficient is achieved. Preferably, the material of the protrusion is selected so that, at least in the region of the existing protrusion surfaces, minimal wear by abutting chain links will result.

The protrusion and/or the channel may be porous, in which case the porous material may contain available lubricating or maintenance materials for the chain or the chain guide. The channel, in particular its mouth opening region and the protrusion are particularly suitable for the application of lubricants and maintenance materials to the chain. At these locations, the chain links may be exposed radially on the inside or be at least relatively not stressed, these locations representing the most stressed locations of a chain that is being pulled and being subjected to frictional forces. Therefore, the application of active material is particularly effective here. Preferably, a lubricating device is provided in or on the channel and/or in or on the protrusion. In particular, a lubricant supply may be arranged there. For example, a lubricating felt or a lubricating channel may be arranged in the channel or in the protrusion. Lubricants may be, for example, oils, fats and/or graphite.

For retrofitting a chain hoist, it is possible, for example to design the chain guide as a component separate from the remaining chain hoist or, for example, as part of a housing of the chain hoist.

Preferably, the chain hoist comprises at least two crane hooks. A crane hook may be configured as a swivel hook with a swivel bearing and thus be rotatable relative to the chain axis, without the chain rotating as a result of this. In the case of a chain pile including some chain links that are greatly twisted relative to each other and are resting on the end surface, a strong torque must be applied to the chain through the chain guide when said chain is being retracted. As a result of this, a swivel hook is not impaired by the rotatability of the chain.

DESCRIPTION OF THE PREFERRED EMBODIMENTS

Figure 1:
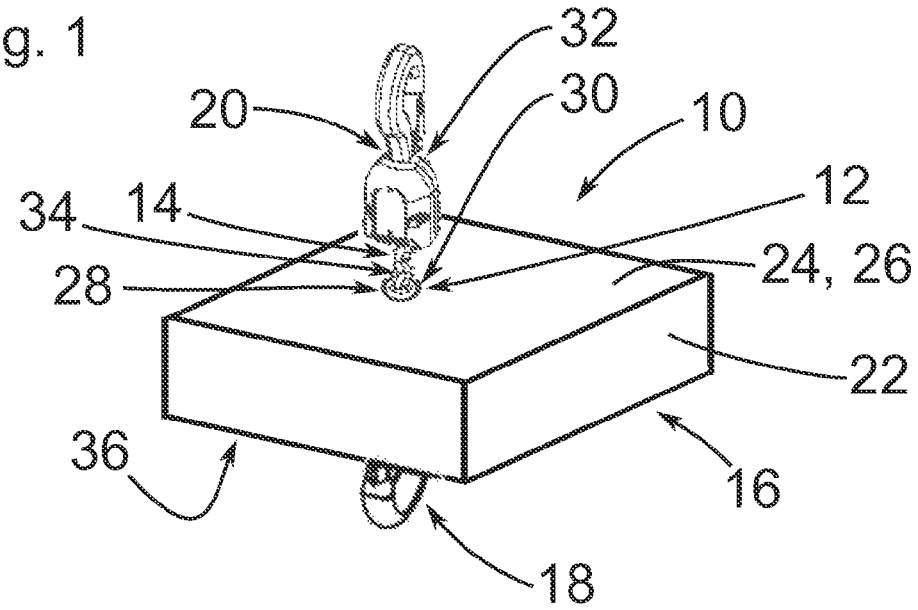
FIG. 1 is a perspective of an illustrative chain hoist having a chain guide in accordance with the invention.

Referring now more particularly to FIG. 1 of the drawings, there is shown an illustrative chain hoist 10 having a chain guide 12 in accordance with the invention for use with a link chain 14. The chain hoist 10 comprises a housing 16 that can hold a chain sprocket and a motor, and, for example, a slip friction clutch. The chain hoist 10 comprises a hook 18 that, in the exemplary embodiment, is fastened to the housing 16 but also comprises a swivel bearing. The hook 18 can be used for fastening to a load that is to be lifted or to be lowered by the chain hoist 10. The chain hoist 10 comprises a hook block 20 that is connected to the chain 14. The chain 14 moves from the chain guide 12 to the hook block 20 over a roller at the hook block 20 and back again to the housing 16, where the end of the chain 14 is fastened. The fastening means may also be configured as a hook 20 to which the chain is fastened and which does not move back to the housing 16.

The housing 16 has lateral walls 22 and a housing surface 24. Above the chain sprocket provided in the housing, there is a channel 36 of a chain guide 20. The channel 36 terminates in a mouth opening 28 on the surface 24 that, at the same time, represents the end surface 26 of the chain guide 12. Formed at the mouth opening 28, there is a protrusion 30. At the protrusion 30, the chain 14 moves through the mouth opening 28 into the housing 16 of the chain hoist 10.

The hook block 20 can be hooked at a fastening height to a stage scaffolding, for example. The load is fastened to the hook 18 and moved up and down on the chain 14, together with the housing 16. In the exemplary embodiment, the hook block 20 is equipped with a swivel bearing 32 and, in this manner, configured as a swivel hook. Therefore, the hook block 20 can be rotated, without the link chain 14 being twisted.

In the depicted exemplary embodiment, the chain hoist 10 is in a state that approximately corresponds to the initial state at the place of use. The link chain 14 extends through the housing 16 in a stored condition. With the aid of the lifting motor, the chain 14 is moved out of the housing and hooked at a fastening height above the stage floor. A load fastened to the hook 18 can then be lifted with the chain hoist 10, in which case the chain 14 is retracted through the mouth opening 28 through the housing surface/end surface 24, 26.

After its use, the housing 16 is lowered to the stage floor and the hook block 20 is detached from the stage scaffolding. The chain 14 is deposited on the housing surface 24 or on the end surface 26 and retracted through the mouth opening 28 by means of the lifting motor. The protrusion 30 may be configured, for example, as a component of the housing surface 24 projecting from the otherwise plane housing surface, or may be added as a superstructure to the housing surface 24 or be an insert in the housing 16.

Figure 2A:
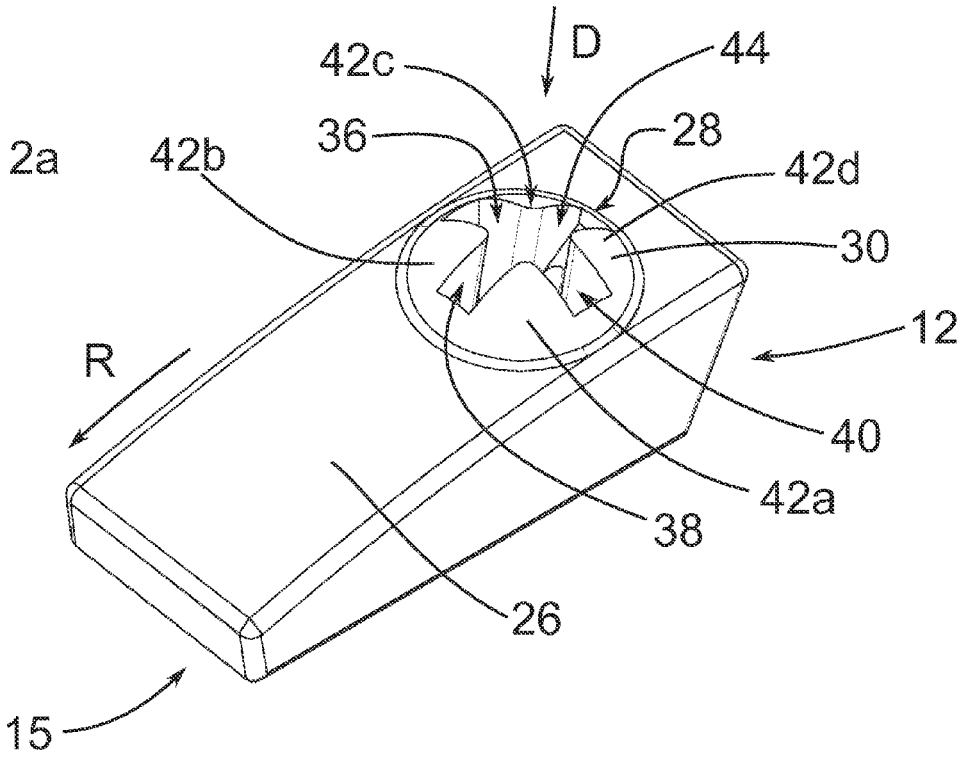
FIG. 2*a* is an enlarged perspective of a chain guide in the form of an inserted component in accordance with the invention.
Figure 2B:
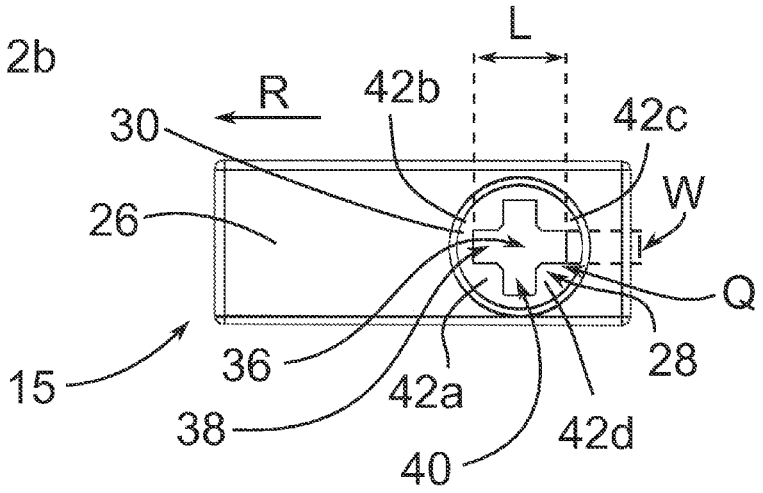
FIG. 2*b* is a top plan view of the chain guide shown in FIG. 2*a*

FIGS. 2*a* and 2*b* show an inventive chain guide 12 as a separate component 15. The component 15 may be immovably or movably connected to the housing 16, for example with screws, cement or by welding. The chain guide of the exemplary embodiment may be set up as an insert or as an attachment for a housing 16 of a chain hoist 10. FIG. 2*a* is a perspective view and FIG. 2*b* is a plan view of a chain guide in accordance with the invention. The chain guide 12 has a channel 36 with a cruciform cross-section Q. FIG. 2*b* shows a cross-section Q of the channel 36. The channel 36 has a first guide groove pair 38 and a second guide groove pair 40 that are oriented transversely with respect to each other. The end surface 26 of the chain guide 12 extends from the mouth opening 28 of the channel 36, away from said channel. Considering the depicted exemplary embodiment, the end surface 26 drops obliquely downward in an inclined direction R relative to the through-passage direction D. The end surface 26 is curved in a convex manner, but it may also be straight, for example.

The channel 36 defines a through-passage direction D. In the exemplary embodiment, the first 42*a*, second 42*b*, third 42*c* and fourth protrusion surface 42*d* are curved around the mouth opening 28 of the protrusion 30. In doing so, the protrusion 30 has the form of a spherical segment. Protrusion surfaces 42*a-d*, may also drop obliquely downward, for example, thus resulting in the form of a pyramid. One or more protrusion surfaces 42*a-d* may also extend horizontally or parallel to the end surface 26. A guide groove pair 38, 40 has—in cross-section—a first extension L and a second extension W. The first extension L and the second extension W of the first guide groove pair 38 and the second guide groove pair 40 may be different. The first extensions L of the first and the second guide groove pairs of the channel 36 increase at least in a mouth opening section of the channel counter the through-passage direction or in the direction of the end surface 26. This means that the channel 36 widens in the direction counter the through-passage direction. In the first and the second guide groove pairs 38,40, there may be a lubricating device 44, for example in the form of a lubricating felt. Due to the first through the fourth protrusion surfaces 42*a-d* the end surface 26 is continued beyond the protrusion 30. The protrusion 30 extends over the mouth opening 28, i.e., radially over the channel 36. The protrusion 30 is centered on the mouth opening 28.

Figure 3:
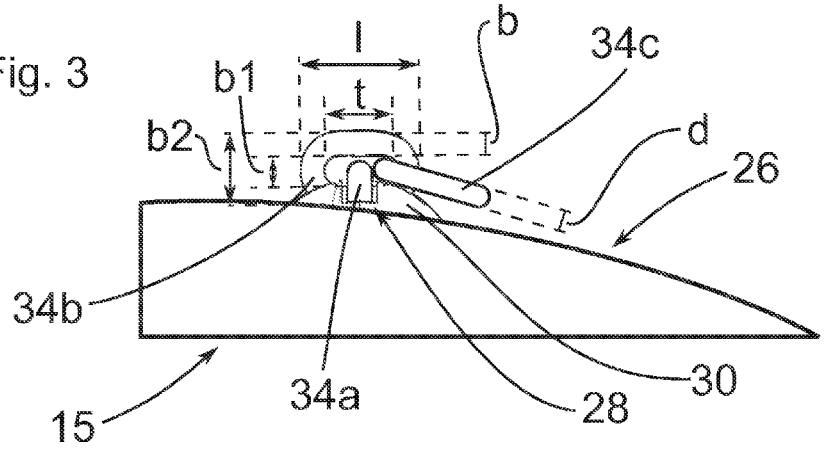
FIG. 3 is a side view of another embodiment of a chain hoist with a chain guide in accordance with the invention.

FIG. 3 shows a side view of a chain guide 12 for a chain hoist 10 in which a first chain link 34*a* is depicted that belongs to a chain section extending through the channel 36. A second chain link 34*b* is positioned sideways to illustrate the rotating mechanism relative to the mouth opening 28. Furthermore, the chain link 34*b* is shown positioned sideways relative to the end surface 26. A third chain link 34*c* following the sideways positioned second chain link 34*b* is oriented approximately along the end surface 26 and abuts against the first and the second protrusion surfaces 42*a, b* of the protrusion 30. The chain link has a length l, a division t, an inside width b1, an outside width b2, a width of the chain link body b, and a thickness d. The protrusion 30 has a height H relative to the end surface 26 (see FIGS. 4 and 5). Preferably, the height H is approximately 20% to 80% of the chain link length l. In the region of the protrusion 30, the channel 36 extends over a first extension L (see FIG. 2*b*) that allows a rotation of the sideways positioned chain link 34*b*.

The chain guide in accordance with FIG. 2 may be made of metal. The chain guide may also comprise plastic. For example, the protrusion and/or parts of the protrusion may consist of plastic. It is also possible to use other materials such as, for example, wood, rubber and/or carbon, for the chain guide or for parts of the chain guide.

Figure 4:
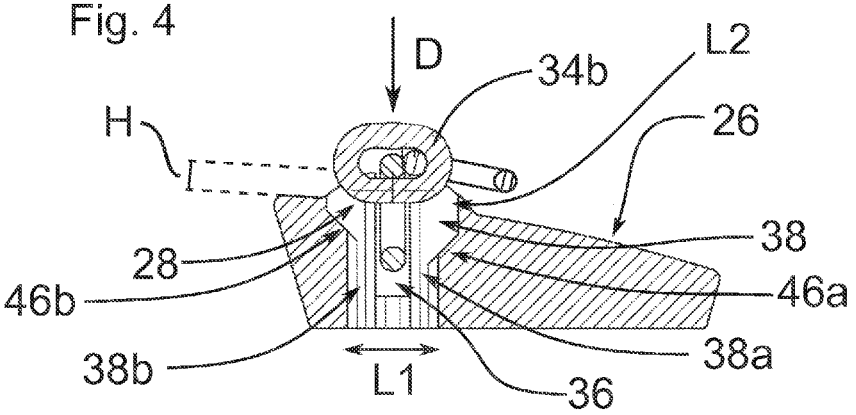
FIG. 4 is a vertical section of the inventive chain guide.

FIG. 4 shows a cross-section along the through-passage direction D through the channel 36, in particular the first guide groove pair 38. As apparent, the channel 36 widens in the direction toward the end surface 26 counter the through-passage direction D. The channel initially has a first extension having the dimension L1 and a mouth-opening-side part of the channel 36 has a first extension having the dimension L2. The transition occurs in steps, with a first step 46*a* first on the first side 38*a* and in the direction of the end surface 26 with a second step 46*b* on the other side 38*b*, thus resulting in an asymmetrical cross-section of the channel 36. In the region of the mouth opening 28 the channel 36 is widened so that a rotation of the sideways oriented chain link 34*b* is possible.

Figure 5:
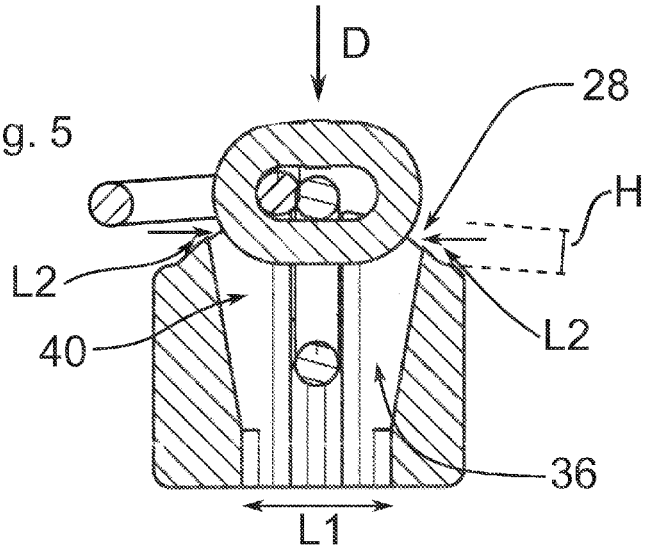
FIG. 5 is an enlarged vertical section of the inventive chain guide.

FIG. 5 shows another cross-sectional view of a chain guide 12 having a cross-section through the channel 36, in particular the second guide groove pair 40. The channel 36 terminates at the mouth opening 28. The second guide groove pair 40 of the channel 36 widens symmetrically and monotonously in the direction toward the end surface 26 along a straight line from the first extension having the dimension L1 to a first extension having the dimension L2.

In all embodiments, a sensor, e.g., a switch, can be provided to detect any potential chain jamming. For example, the component may be movable against the force of a spring in the direction of the channel 36 and actuate a correspondingly arranged switch. The signal emitted by the switch may act to stop or reverse the driving motor.

From the foregoing, it can be seen that a chain hoist 10 in accordance with the invention is provided that has an improved chain guide 12 for a link chain 14. The chain guide 12 comprises a channel 36 having a cruciform cross-section through which the link chain 14 may extend. An end surface 26 of the chain guide 12 extends from a mouth opening 28 of the channel 36, away from said channel. The channel 36 defines a through-passage direction D which widens in the direction of the end surface 26, and a protrusion 30 is formed on the end surface 26 around the mouth opening 28 of the channel 36.

LIST OF REFERENCE SIGNS

| | |
|---|---|
| 10 | Chain hoist |
| 12 | Chain guide |
| 14 | Link chain |
| 15 | Structural component |
| 16 | Housing |
| 18 | Hook |
| 20 | Hook block |
| 22 | Lateral walls |
| 24 | Housing surface |
| 26 | End surface |
| 28 | Mouth opening |

-continued

| | |
|---|---|
| 30 | Protrusion |
| 32 | Pivot bearing |
| 34 (a-c) | Chain link |
| 36 | Channel |
| 38 | First guiding groove pair |
| 38 a, b | First and second sides |
| 40 | Second guiding groove pair |
| 42 a-d | first to fourth protruding surfaces |
| 44 | Lubricating device |
| 46 a, b | First and second steps |
| R | Oblique direction |
| D | Through-passage direction |
| L | First extension |
| L1, L2 | Dimensions of the first extension |
| W | Second extension |
| b1 | Inside width |
| b2 | Outside width |
| b | Width |
| d | Thickness |
| l | Length |
| t | Division |
| H | Height |
| Q | Cross-section |

The invention claimed is:

1. A chain hoist (10) comprising a chain guide (12) for guiding movement of a link chain (14) formed of interconnected elongated links 34*a*, 34*b*, 34*c*, said chain guide (12) being formed with a channel (36) which has a cruciform cross-section and through which the link chain (14) extends, said chain guide (12) having an end face (26) having a contour which surrounds and extends away from a mouth opening (28) of said channel (36), said channel (36) having a through-passage direction (D) along which the link chain is moveable in said chain guide channel (36), said chain guide channel (36) widening in the direction toward the end surface (26), a protrusion (30) extending outwardly of the contour on the end surface (26) so as to form an elevation above the end face (26) and through which the mouth opening (28) of the channel (36) extends, and said chain being moveable into said mouth opening (28) and through said chain guide channel (36) with individual elongated links of the link chain (14) passing over the protrusion (30) in sideways relation to the protrusion (30) with ends of the links (34*b*) above the end face (26) of the chain guide (12) before entering the mouth opening (28) of the channel (36).

2. The chain hoist (10) of claim 1 in which said end face (26) of said chain guide (12) is at least partially arcuate in shape.

3. The chain hoist (10) of claim 1 in which said end surface (26) of the chain guide (12) is inclined relative to the through-passage direction (D).

4. The chain hoist (10) as of claim 1 in which said channel (36) has, in cross-section (Q), two guide groove pairs (38, 40) oriented transversely with respect to each other, and at least one of the guide groove pairs (38, 40) widens in the direction of the end surface (26) with at least one step (46*a*, *b*).

5. The chain hoist (10) of claim 1 in which said protrusion (30) has a height (H) of 20% to 80% of a length (l) of a link of the link chain (14).

6. The chain hoist (10) of claim 1 in which said protrusion (30) has at least one planar surface (42*a*-*d*).

7. The chain hoist (10) of claim 1 in which said protrusion (30) has at least one arcuate surface (42*a*-*d*).

8. The chain hoist (10) of claim 1 in which said protrusion (30) has the form of one of a spherical segment, a conical form, or pyramidal form.

9. The chain hoist (10) of claim 1 in which said chain guide (12) is made of metal.

10. The chain hoist (10) of claim 1 including a lubricating device (44) formed in or on at least one guide groove pair (38, 40).

11. The chain hoist (10) of claim 1 in which said chain guide (12) is a component (15) separate from the remaining chain hoist (10).

12. The chain hoist (10) of claim 1 including at least one swivel hook block.

13. A chain hoist (10) comprising a housing through which a link chain passes, a chain guide (12) for guiding movement of the link chain (14) formed of interconnected elongated links 34*a*, 34*b*, 34*c* through said housing, said chain guide (12) being formed with a channel (36) which has a cruciform cross-section and through which the link chain (14) extends, said chain guide (12) having an end face (26) having a contour which surrounds and extends away from a mouth opening (28) of said channel (36), said channel (36) having a through-passage direction (D) along which the link chain is moveable in said chain guide channel (36), said chain guide channel (36) widening in the direction toward the end surface (26), a protrusion (30) extending outwardly of the contour on the end surface (26) so as to form an elevation above the end face (26) and through which the mouth opening (28) of the channel (36) extends, and said chain being moveable into said mouth opening (28) and through said chain guide channel (36) with individual elongated links of the link chain (14) passing over the protrusion (30) in sideways relation to the protrusion (30) with ends of the links (34*b*) above the end face (26) of the chain guide (12) before entering the mouth opening (28) of the channel (36).

14. The chain hoist (10) of claim 13 in which said chain guide (12) is a component (15) separate from the housing.

15. The chain hoist (10) as of claim 14 in which said channel (36) has, in cross-section (Q), two guide groove pairs (38, 40) oriented transversely with respect to each other, and at least one of the guide groove pairs (38, 40) widens in the direction of the end surface (26) with at least one step (46*a, b*).

16. The chain hoist (10) of claim 15 in which said end face (26) of said chain guide (12) is at least partially arcuate in shape.

17. The chain hoist (10) of claim 16 in which said protrusion (30) has a height (H) of 20% to 80% of a length (l) of a link of the link chain (14).

18. The chain hoist (10) of claim 15 in which said protrusion (30) has the form of one of a spherical segment, a conical form, or pyramidal form.

* * * * *